US012292259B2

(12) United States Patent
Huseman

(10) Patent No.: US 12,292,259 B2
(45) Date of Patent: May 6, 2025

(54) PIVOTAL TACTICAL LIGHTS FOR FIREARMS

(71) Applicant: Jonathan V. Huseman, Granbury, TX (US)

(72) Inventor: Jonathan V. Huseman, Granbury, TX (US)

( * ) Notice: Subject to any disclaimer, the term of this patent is extended or adjusted under 35 U.S.C. 154(b) by 100 days.

(21) Appl. No.: 18/382,492

(22) Filed: Oct. 21, 2023

(65) Prior Publication Data

US 2024/0263916 A1 Aug. 8, 2024

Related U.S. Application Data

(60) Provisional application No. 63/509,271, filed on Jun. 20, 2023, provisional application No. 63/444,061, filed on Feb. 8, 2023.

(51) Int. Cl.

| | |
|---|---|
| ***F41G 1/35*** | (2006.01) |
| ***F41G 11/00*** | (2006.01) |
| *F41C 23/16* | (2006.01) |
| *F41G 1/38* | (2006.01) |

(52) U.S. Cl.

CPC ..... *F41G 1/35* (2013.01); *F41G 11/007* (2013.01); *F41C 23/16* (2013.01); *F41G 1/38* (2013.01); *F41G 11/003* (2013.01)

(58) Field of Classification Search

CPC . F41G 1/35; F41G 11/007; F41G 1/38; F41G 11/003; F41C 23/16

See application file for complete search history.

(56) References Cited

U.S. PATENT DOCUMENTS

| | | | | |
|---|---|---|---|---|
| 7,559,167 | B1 | 7/2009 | Moody et al. | |
| 7,736,013 | B2 * | 6/2010 | Griffin | F21V 21/08 362/120 |
| 8,166,694 | B2 * | 5/2012 | Swan | F41C 33/007 224/198 |
| 8,393,104 | B1 | 3/2013 | Moody et al. | |
| 8,714,423 | B1 * | 5/2014 | Kincaid | F41G 1/35 224/198 |
| 9,335,119 | B2 * | 5/2016 | Werner | F41G 1/35 |
| 9,777,994 | B2 * | 10/2017 | Hancosky | F41G 1/54 |
| 10,921,092 | B2 * | 2/2021 | Libotte | F41G 1/30 |
| 11,118,861 | B2 * | 9/2021 | Holmes | F41C 23/14 |
| 11,262,168 | B1 * | 3/2022 | Morse | F41G 3/165 |
| 11,385,026 | B2 * | 7/2022 | Roberson | F41G 11/001 |
| 2005/0204603 | A1 | 9/2005 | Larsson | |
| 2009/0084016 | A1 | 4/2009 | Wu | |

(Continued)

*Primary Examiner* — Michelle Clement

(74) *Attorney, Agent, or Firm* — bobharter.com; Robert J. Harter

(57) ABSTRACT

A light apparatus for firearms can pivot between a safety position and a shooting position. In the safety position, a light mounted to the firearm can point straight ahead at a target, while the firearm's barrel is pointed downward. In the shooting position, both the light and the barrel point in the same direction. In some examples, the light is supported by a gun mounting member that is fastened to the underside of the firearm, while the light is offset to one side of the barrel. In some examples, the light is connected to a foregrip, so the light and the foregrip can pivot together as a unit relative to the barrel. Some examples of the light apparatus include various devices for holding the light at the safety and/or shooting position.

20 Claims, 11 Drawing Sheets

(56) References Cited

U.S. PATENT DOCUMENTS

| | | | | |
|---|---|---|---|---|
| 2009/0193702 | A1 | 8/2009 | Lin | |
| 2013/0333263 | A1* | 12/2013 | Hovey | F41C 23/16<br>42/72 |
| 2014/0157644 | A1* | 6/2014 | Jiminez | F41G 11/003<br>42/114 |
| 2022/0333899 | A1* | 10/2022 | Roberson | F41G 11/001 |

* cited by examiner

PIVOTAL TACTICAL LIGHTS FOR FIREARMS

CROSS REFERENCE TO RELATED APPLICATIONS

This application claims the benefit of provisional patent application Ser. No. 63/444,061 filed on Feb. 8, 2023 by the present inventor and is incorporated by reference in its entirety, and this application also claims the benefit of provisional patent application 63/509,271 filed on Jun. 20, 2023 by the present inventor and is incorporated by reference in its entirety.

FIELD OF THE DISCLOSURE

This patent generally pertains to firearms and more specifically to tactical lights mountable to firearms.

BACKGROUND

Tactical lights mountable on firearms, such as rifles and handguns, are essential accessories for both civilian and professional users. These compact yet powerful illumination tools have revolutionized low-light and nighttime shooting scenarios, enhancing safety, accuracy, and situational awareness for users across various contexts.

One of the primary functions of a tactical light is to provide a strong, focused beam of light, allowing the shooter to identify potential threats, obstacles, or targets in dimly lit environments. Whether it's a home defense situation, law enforcement operation, or military engagement, the ability to quickly and effectively illuminate an area is critical.

Mounting options for these lights vary, but they are typically designed to attach securely to the accessory rail or mounting points on firearms, such as Picatinny or M-Lok rails. This ensures stability and prevents the light from shifting during recoil or movement. The activation of these lights is often designed to be ergonomic, allowing for easy on/off control without altering the shooter's grip or compromising their shooting stance.

For handguns, tactical lights are particularly valuable for concealed carry permit holders, law enforcement officers, and security professionals. They enable quick target identification in low-light situations, reducing the risk of misidentification. Additionally, the mere presence of a visible light can deter potential threats.

In the case of rifles, tactical lights are commonly used by military and law enforcement personnel engaged in close-quarters combat or urban operations. These lights can also be valuable for hunters who need to track or identify game in low-light conditions. Many modern tactical lights are rugged and built to withstand harsh environmental conditions, making them dependable tools for those who rely on their firearms in demanding situations.

DETAILED DESCRIPTION

Figure 1:
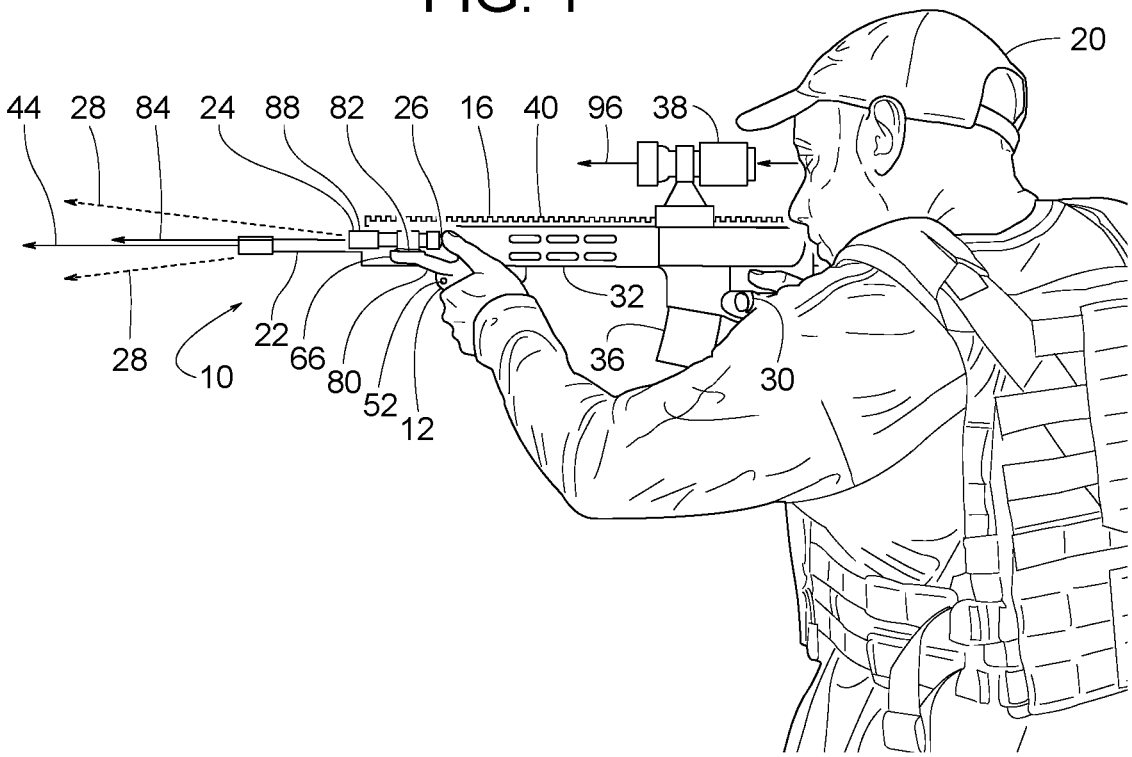
FIG. 1 is a perspective view of an example light apparatus in a shooting position and constructed in accordance with the teachings disclosed herein.

FIGS. 1-23 show various examples of a light apparatus 10 (e.g., light apparatuses 10*a-g*) comprising a frame 12 (e.g., frames 12*a-g*) and a gun mounting member 14 (e.g., gun mounting members 14*a-g*) mountable to a firearm 16 for illuminating a target in a responsible manner. The firearm 16 represents any type gun for shooting a bullet or other type of projectile. Some examples of the firearm 16 include rifles, long guns, shotguns, handguns, pistols, revolvers, short barreled rifles, and short barreled shotguns. An AR-15 is just one of many specific examples of the firearm 16.

The term, "handgun" as used herein refers to any firearm 16 with a barrel shorter than sixteen inches. Handgun examples include pistols and revolvers. Pistols have a single shooting chamber, while revolvers have a revolving cylinder containing a series of chambers.

The term, "long gun" refers to any firearm 16 with a barrel length of at least sixteen inches. Some long guns include a stock 18 for bracing the firearm 16 against a user's shoulder. Some long gun examples include rifles and shotguns. Short barreled rifles and short barreled shotguns; registered firearms with barrels shorter than sixteen inches and eighteen inches, respectively, are designed to be fired with two hands, i.e., not handguns.

Rifles have a barrel with a helically grooved bore, known as rifling. Rifles typically fire a projectile or bullet that prior to shooting is attached to and projects forward from a cartridge case. Shotguns have a barrel with usually a smooth bore. Shotguns typically fire one or more projectiles that prior to shooting are enclosed within a cartridge case.

Figure 2:
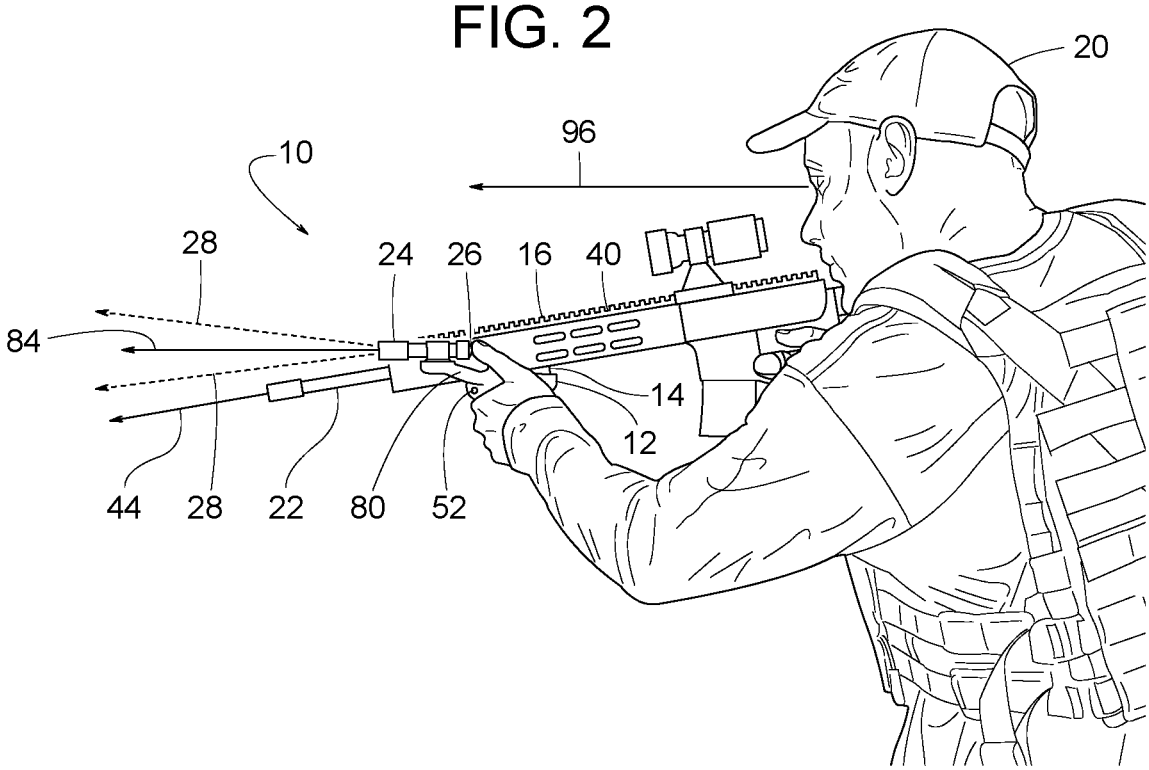
FIG. 2 is a perspective view similar to FIG. 1 but showing the light apparatus in a safety position.

FIG. 1 shows a user 20 with the firearm 16 in a shooting position. In the shooting position, a barrel 22 of the firearm 16 and a light 24 mounted to the firearm 16 both point in the same general direction toward a target. Some examples of the light 24 include tactical lights, flashlights, lasers, night vision illuminators, and various combinations thereof, etc. FIG. 2 shows the firearm 16 in a safety position, wherein the light 24 points in the direction of a target, while the barrel 22 points in a more downward direction.

The light 24, in some examples, includes a switch 26 for turning the light on and off, momentary-on, constant-on, and/or for adjusting the brightness or color of a light beam 28 projected by the light 24. Some known examples of the switch 26 include a click tail cap switch, a clicky, a rocker switch, a momentary tail cap, a remote tape switch, a pressure pad, Mod Button, a Unity Hot Button, etc.

The firearm 16, in some examples, comprises the barrel 22, a stock 18, and a trigger 30. Some examples of the firearm 16 further include a handguard 32, a pistol grip 34, a magazine 36, a scope or sight system 38, and one or more rail integration systems 40 (e.g., an RIS, a rail accessory system, RAS, a rail interface system, a rail system, a gun rail, a rail, Picatinny rail, a dovetail rail, a Weaver rail, an M-LOK, a KEYMOD, etc.). M-LOK is a registered trademark of Magpul Industries Corp. of Austin, TX. KEYMOD is a registered trademark of Bravo Company MFG, Inc., of Hartland, WI.

Figure 3:
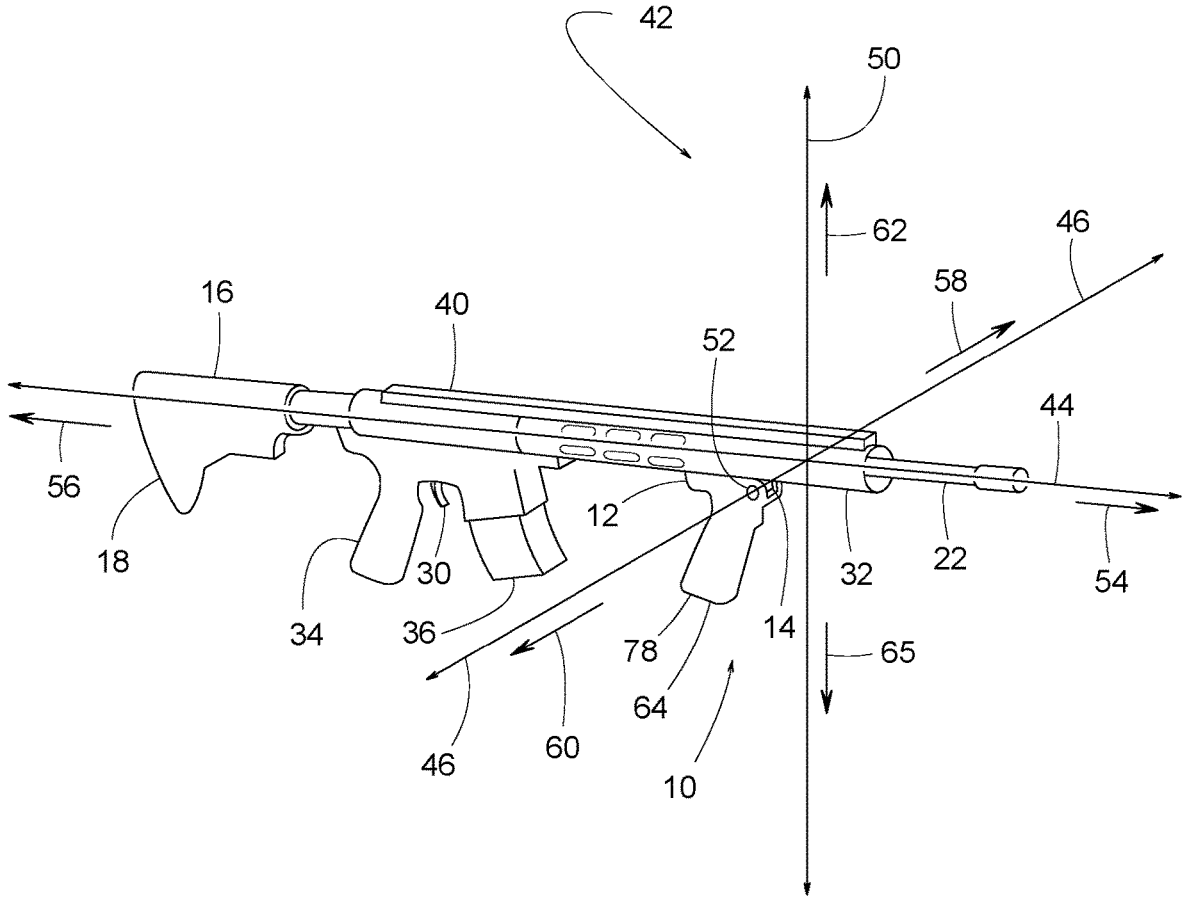
FIG. 3 is a schematic diagram showing a coordinate system to help describe the various examples of the light apparatuses disclosed herein.

FIG. 3 is a schematic diagram showing a three-dimensional coordinate system 42 for the firearm 16. The barrel 22 defines an X-axis 44. An axis of rotation 46 (i.e., a center of rotation) about which the light 24 can pivot or otherwise move relative to the firearm 16 defines a Y-axis. The axis of rotation 46 is substantially perpendicular (i.e., within four degrees of perpendicular) to the X-axis 44, but the X-axis 44 and the axis of rotation 46 do not necessarily intersect. A Z-axis 50 intersects and is substantially perpendicular (i.e., within four degrees of perpendicular) to the X-axis 44 and the axis of rotation 46.

In some examples, the axis of rotation 46 is collinear with a longitudinal centerline of a pin 52 that provides the light 24 with rotational motion. In other examples, the rotational motion is provided by a linkage assembly or some other mechanism, wherein the axis of rotation 46 is still at the light's center of rotation but not necessarily collinear with any pin (e.g., see FIGS. 18 and 19).

The direction the bullet or projectile traveling through the barrel 22 defines a front direction 54 parallel to the X-axis 44. A back direction 56 is opposite to the front direction 54. A left lateral direction 58 is parallel to the axis of rotation 46 and points to the left as view from the user 20 holding the firearm 16 in a normal manner, as shown in FIGS. 1 and 2. A right lateral direction 60 is opposite to the left lateral direction 58. An upward direction 62 is parallel to the Z-axis 50 and points up when the X-axis 44 and the axis of rotation 46 are horizontal while the trigger 30 of the firearm 16 is pointing downward, as shown in FIGS. 1-3. Arrow 65 represents a downward direction, opposite to the upward direction 62.

FIGS. 4-8 show various views of the example light apparatus 10*a*. In this example, the light apparatus 10*a* comprises the frame 12*a* with an optional foregrip 64, a light support member 66 to which the light 24 can be attached, and the gun mounting member 14*a* for connecting the light apparatus 10*a* to the firearm 16. In some examples, the gun mounting member 14 has a mounting surface 68 with a back end 70 and a front end 72. In some examples, the mounting surface 68 engages the firearm 16 to establish a fixed positional relationship between the barrel 22 and the gun mounting member 14. In some examples, the gun mounting member 14 has screw holes 74 with screws 76 for fastening the gun mounting member 14 to the handguard 32 or to another part of the firearm 16.

In some examples, the pin 50 extending along the axis of rotation 46 pivotally connects the frame 12 to the gun mounting member 14. Some examples of the pin 50 include a screw, a rod, a hinge pin, etc. The pin 50 allows the user 20 to pivot the frame 12 and the light 24 about the axis of rotation 46 between the shooting position (FIGS. 1, 4 and 7) and the safety position (FIGS. 2, 5 and 8). In some examples, the pin 50 and axis of rotation 46 is closer to the front end 72 than the back end 70. This allows the firearm 16 to be pointed down while the light 24 shines horizontally without creating interference between the frame 12 and the firearm 16.

In some examples, the foregrip 64 includes a distal end 78 that leans back away from the front of the firearm 16. The leaning back orientation avoids creating an uncomfortable, awkward forward leaning foregrip 64 in the safety configuration.

In some examples, the light support member 66 is at a stationary position relative to the frame 12, so the light 24, the frame 12 and the foregrip 64 can pivot together, as a unit, relative to the firearm 16. In some examples, an arm 80 connects the light support member 66 to the frame 12. In some examples, the frame 12, the arm 80 and the light support member 66 are combined as one seamless unitary piece.

In other examples, the frame 12, the arm 80 and the light support member 66 is a modular assembly (e.g., see FIGS. 20-23). In some examples, the modular assembly can be reconfigured, such that the light 24 can be affixed to the left or right side of the firearm 16 with no additional components. Some examples of such a modular assembly include additional and/or alternative components, such as an extended or adjustable version of the arm 80, an extended or adjustable version of the light support member 66, or integrated versions of the light switch 26. Such a modular assembly can make the light support member 66 readily adaptable to various types and brands of firearm 16.

In some examples, the light support member 66 has a light support surface 82 that establishes a central light pointing direction 84 relative to the frame 12. The term, "central light pointing direction" refers to the general direction the light beam 28 is aimed. In examples where the light beam 28 is diffused and diverges, the central light pointing direction 84 is at the center of the average diffused beam of light 28. In determining a light beams center, shadows cast by the gun's muzzle or other parts of the firearm are disregarded.

In some examples, the light support surface is flat to mate with a flat surface on the light 24. In some examples, the light support surface 82 provides a ledge 86 to support the light 24 such that the ledge 86 is substantially parallel to the central light pointing direction 84. The term, "substantially parallel" means within four degrees of parallel.

In some examples, the light support surface is at least partially cylindrical to mate with a cylindrical shape of the light 24. In some examples, the light support member 66 includes a tubular member 88 to support the light 24. In some examples, the tubular member 88 has a longitudinal centerline that is substantially collinear with the central light pointing direction 84.

Figure 4:
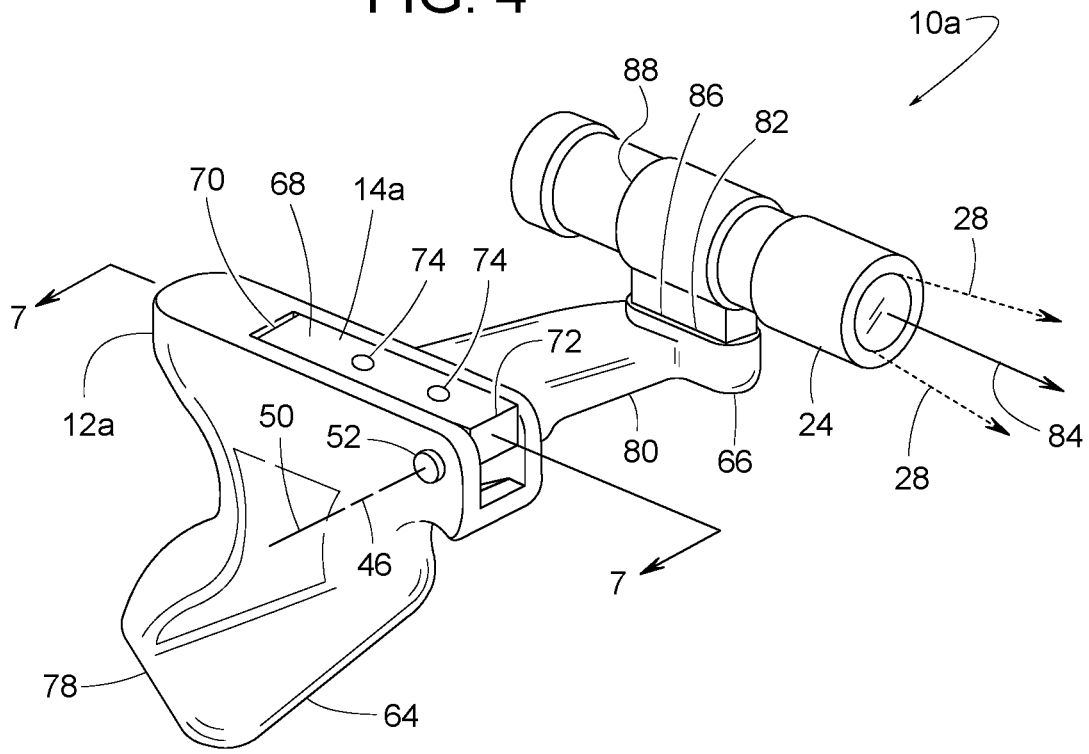
FIG. 4 is a perspective view of an example light apparatus in a shooting position and constructed in accordance with the teachings disclosed herein.
Figure 5:
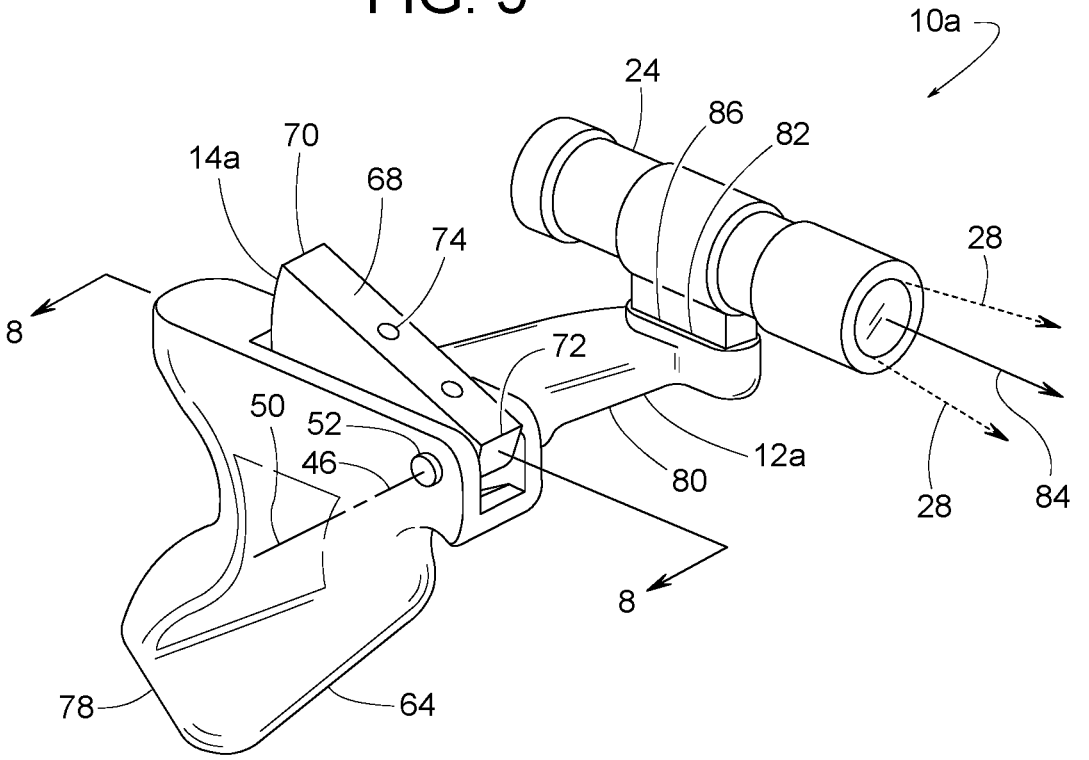
FIG. 5 is a perspective view similar to FIG. 4 but showing the light apparatus in a safety position.

In some examples of the shooting position, the mounting surface 68 is substantially parallel (i.e., within four degrees of parallel) to the central light pointing direction 84, as shown in FIG. 4. In some examples when the frame 12 is in the safety position while the central light pointing direction 84 is horizontal, as shown in FIG. 2, the mounting surface 68 slopes downward from the back end 70 to the front end 72, as shown in FIGS. 5 and 8. Thus, the barrel 22 slopes down as well because, in such examples, the barrel 22 and the mounting surface 68 are substantially parallel (i.e., within four degrees of parallel).

Figure 6:
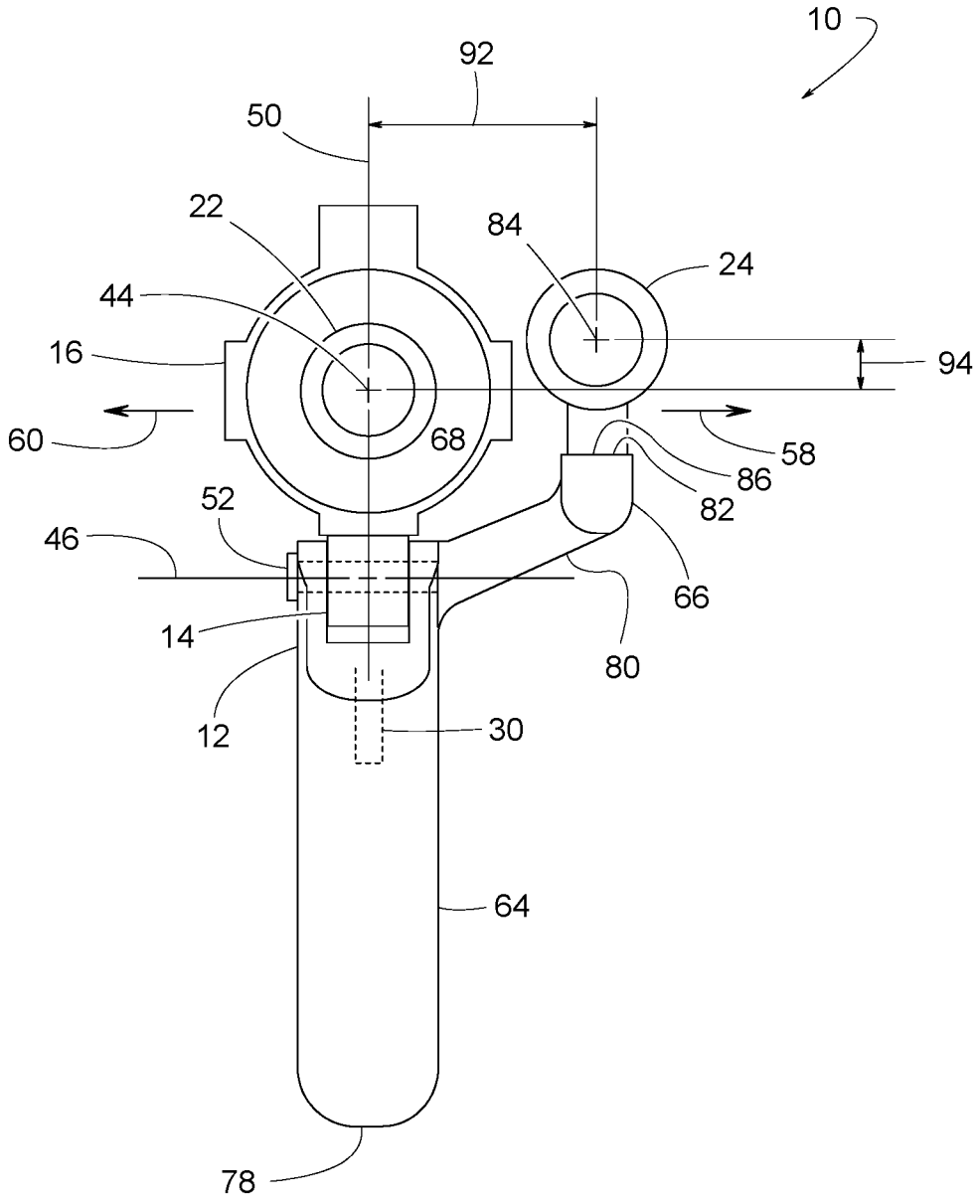
FIG. 6 is an end view of an example firearm and light apparatus constructed in accordance with the teaching disclosed herein, wherein the end view looks along the X-axis in the back direction into a barrel.

In some examples, the light 24 is laterally offset to the firearm 16 in the lateral direction 58 or 60, such that when the barrel 22 is horizontal with the trigger 30 extending downward, as shown in FIG. 6, the frame 12 extends underneath the barrel 22 while the light 24 is laterally off to one side of the barrel 22, as indicated by a dimension 92. The lateral offset relationship allows pivoting from the shooting position to the safety position without interference between the light 24 and the barrel 22, even though the frame 12 is mounted underneath the barrel 22. The frame 12 extending underneath the barrel 22 allows the gun mounting member 14 to be conveniently attached under the barrel 22, so the light apparatus 10 does not interfere with the operation of the firearm 16.

In some examples, the light 24 is further mounted vertically offset to the barrel 22, as indicated by a dimension 94. The light 24 being both vertically and laterally offset to the barrel 22 minimizes the extent to which the barrel 22 and/or the handguard 32 casts a shadow on the target. If the light 24 is too high, it can interfere with the user's line of vision 96. If the light 24 is too low, it can interfere with the user 20 grasping the foregrip 64.

Figure 7:
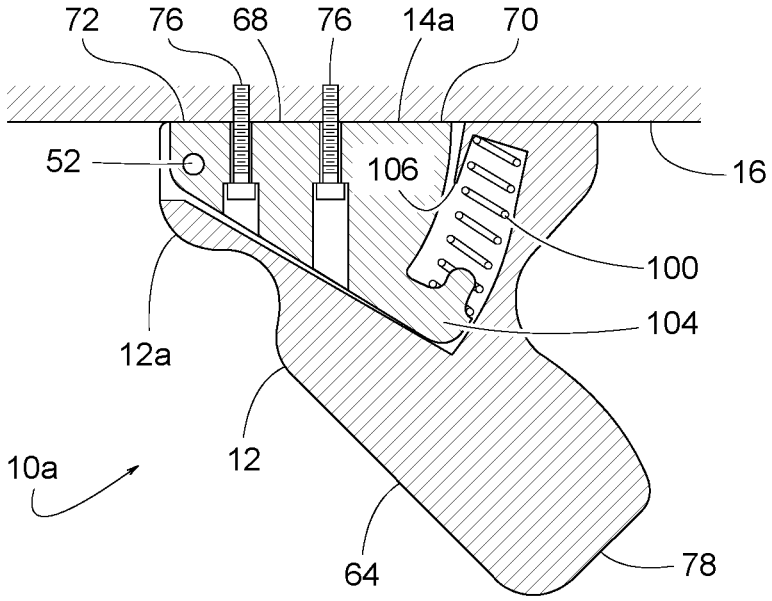
FIG. 7 is a perspective view of an example light apparatus in a shooting position and constructed in accordance with the teachings disclosed herein.
Figure 8:
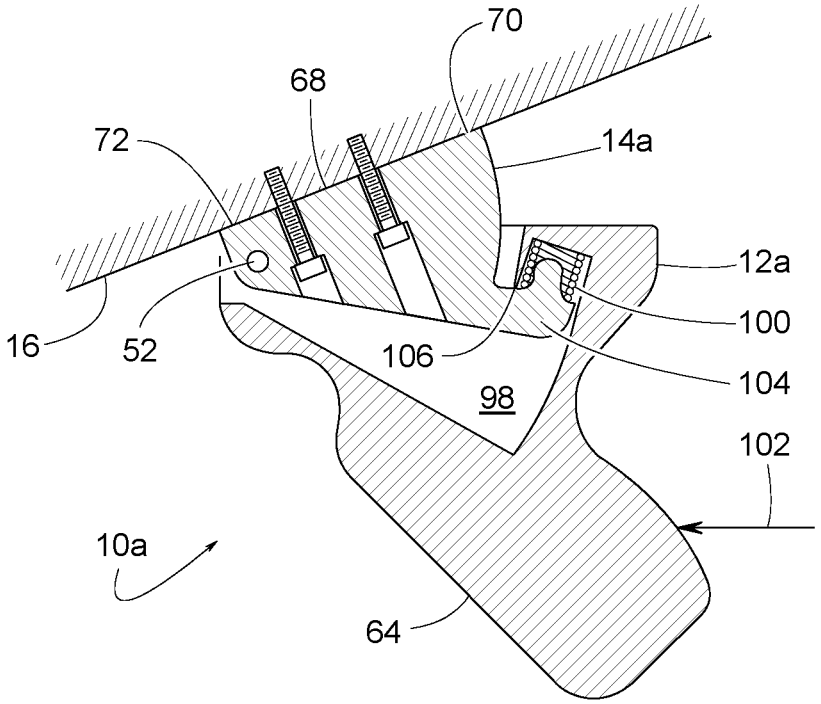
FIG. 8 is a perspective view similar to FIG. 7 but showing the light apparatus in a safety position.

Referring to FIGS. 7 and 8, some examples of the light apparatus 10*a* include a cavity 98 in the frame 12*a*, and the gun mounting member 14*a* extends down into the cavity 98. In some examples, a spring 100 inside the cavity 98 urges the frame 12*a* to its shooting position, as shown in FIG. 7.

In some examples, the user 20 applying a forward force 102 against the foregrip 64 of the frame 12*a* overcomes the force of the spring 100 to move the frame 12*a* to its safety position, as shown in FIG. 8. In some examples, a protrusion 104 extending from the back end of the gun mounting member 14*a* engages a backstop 106 on the frame 12 to limit how far the gun mounting member 14*a* can move relative to the frame 12*a*. The protrusion 104 is spaced apart from the backstop 106 when the frame 12*a* is in the shooting position, as shown in FIG. 7.

As an alternative to applying the forward force 102 directly against the foregrip 64, some examples of the light apparatus 10 include a mechanical linkage system (e.g., assembly of rods, levers, bellcranks, cables, etc) for moving the frame 12 between is safety position and shooting position.

Figure 9:
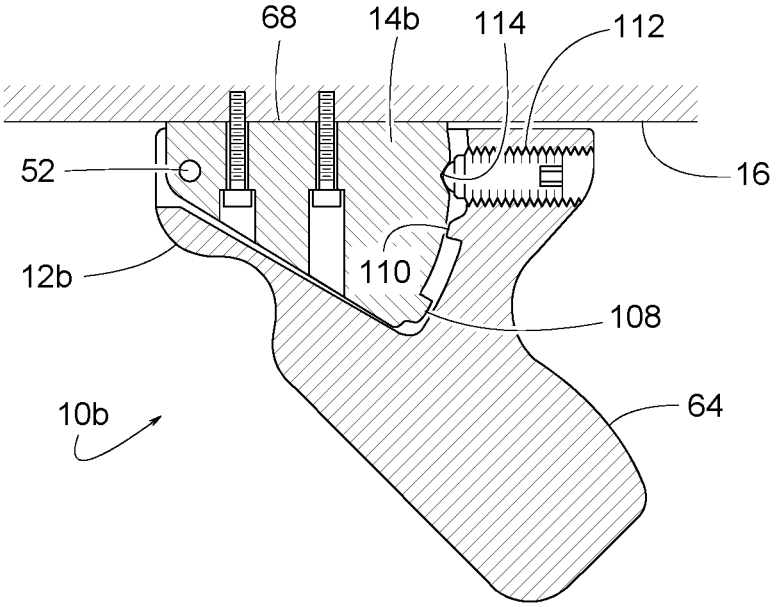
FIG. 9 is a perspective view of an example light apparatus in a shooting position and constructed in accordance with the teachings disclosed herein.
Figure 10:
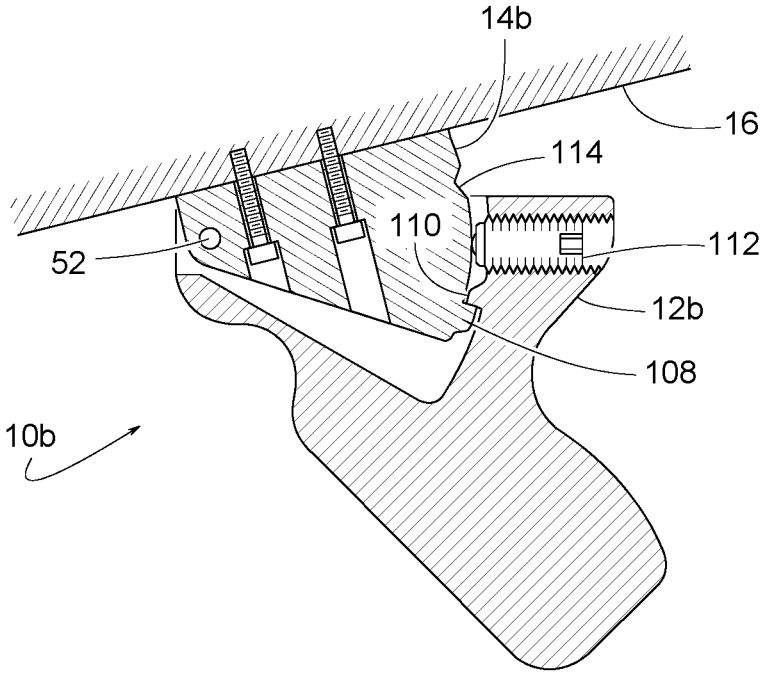
FIG. 10 is a perspective view similar to FIG. 9 but showing the light apparatus in a safety position.

FIGS. 9 and 10 show the light apparatus 10*b* comprising a protrusion 108, a backstop 110, and a spring loaded detent 112 (e.g., a ball plunger). In some examples, the spring loaded detent 112 extends into a recess 114 in the gun mounting member 14*b* to help hold the gun mounting member 14*b* stationary relative to the frame 12*b* when the frame 12*b* is at its shooting position, as shown in FIG. 9.

In some examples, the protrusion 108 extending from the back end of the gun mounting member 14*b* engages the backstop 110 on the frame 12*b* to limit how far the gun mounting member 14*b* can move relative to the frame 12*b*. The protrusion 108 engages the backstop 110 when the gun mounting member 14*b* is in the safety position, as shown in FIG. 10. The protrusion 108 is spaced apart from the backstop 110 when the gun mounting member 14*b* is in the shooting position, as shown in FIG. 9.

Figure 11:
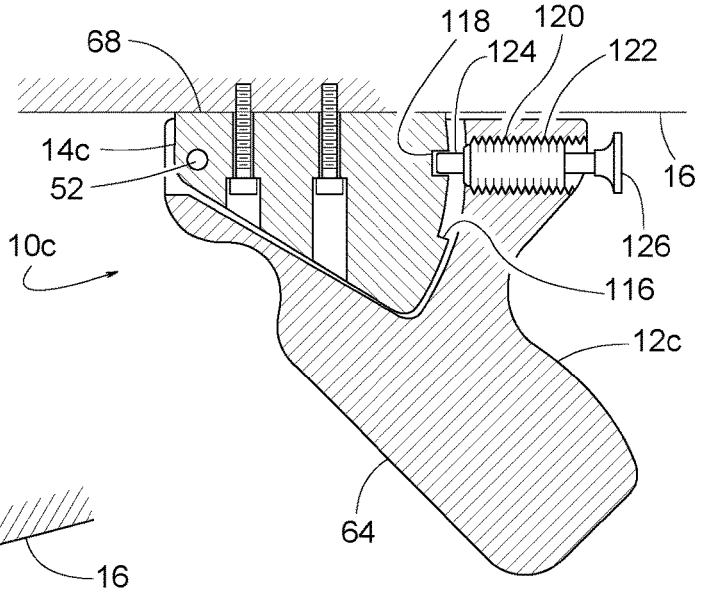
FIG. 11 is a perspective view of an example light apparatus in a shooting position and constructed in accordance with the teachings disclosed herein.
Figure 12:
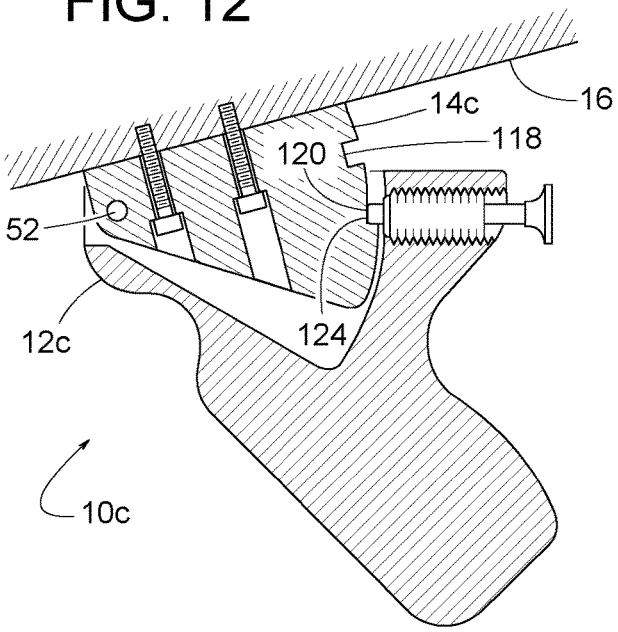
FIG. 12 is a perspective view similar to FIG. 11 but showing the light apparatus in one safety position.
Figure 13:
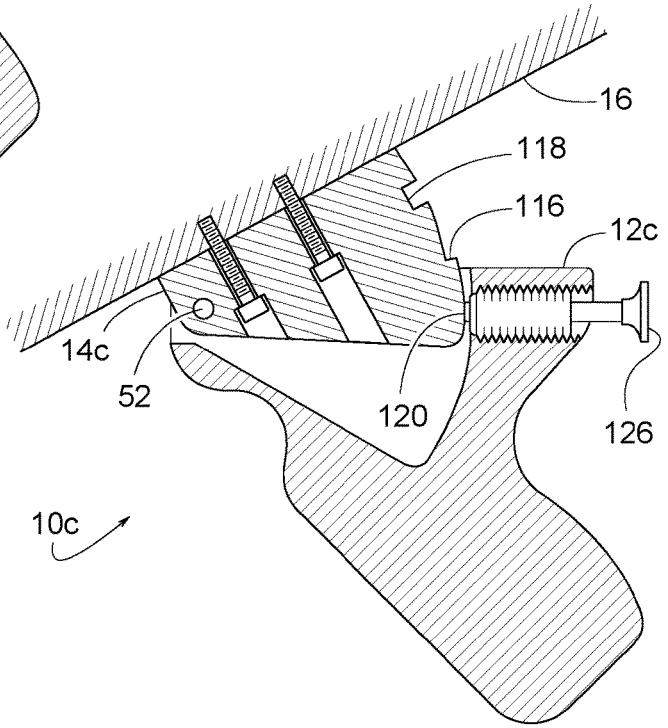
FIG. 13 is a perspective view similar to FIGS. 11 and 12 but showing the light apparatus in another safety position.

FIGS. 11-13 show the light apparatus 10*c* comprising a protrusion 116, a recess 118, and a movable backstop 120. The backstop 120 is movable selectively to a first restraining position (FIG. 11), a second restraining position (FIG. 12), and a release position (FIG. 13).

In some examples, the movable backstop 120 includes a housing 122 attached to the frame 12*c*, a spring loaded pin 124 extending through the housing 122, and a knob 126 attached to the pin 124. The spring force urges the pin 124 toward the gun mounting member 14*c*. The user 20 can use the knob 126 for pulling the pin 124 away from the gun mounting member 14*c* in opposition to the spring force.

In the shooting position, shown in FIG. 11, spring force pushes the pin 124 into the recess 118, placing the backstop 120 in the first restraining position. This helps hold the frame 12*c* substantially stationary relative to the gun mounting member 14*c* in the shooting position.

To switch to a first safety position, shown in FIG. 12, the user 20 pulls the knob 126 partially back to retract the pin 124 out from within the recess 118, placing the backstop 120 in the second restraining position. This allows relative pivotal motion between the gun mounting member 14*c* and the frame 12*c* until the pin 124 of the movable backstop 120 engages the protrusion 116.

To switch to other safety positions, as shown in FIG. 13, the user 20 pulls the knob 126 farther back to disengage the pin 124 from the protrusion 116, placing the backstop 120 in the release position. This allows extended relative pivotal motion between the gun mounting member 14*c* and the frame 12*c*. In some examples, with the extended range of motion, the barrel 22 can be pointed in a low-ready position, while the central light pointing direction 84 is horizontal. In some examples, the barrel 22 can even be pointed straight down, while the central light pointing direction 84 is horizontal.

Figure 14:
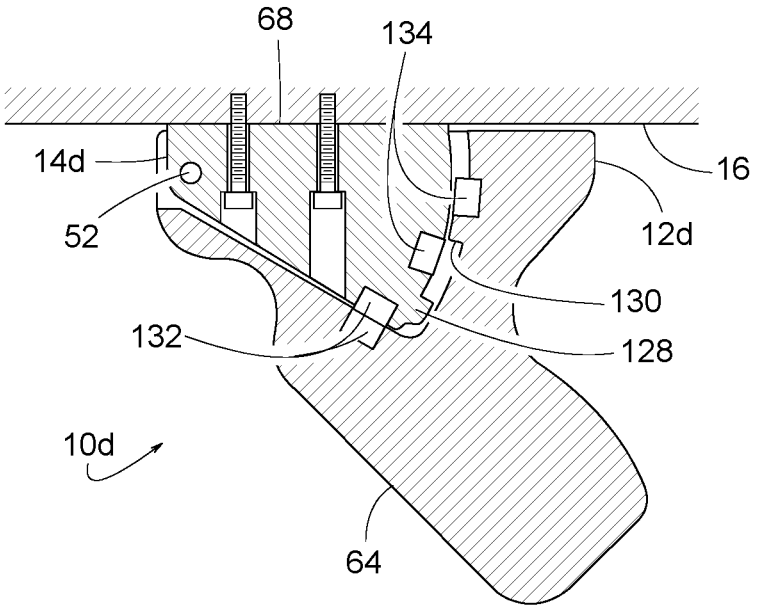
FIG. 14 is a perspective view of an example light apparatus in a shooting position and constructed in accordance with the teachings disclosed herein.
Figure 15:
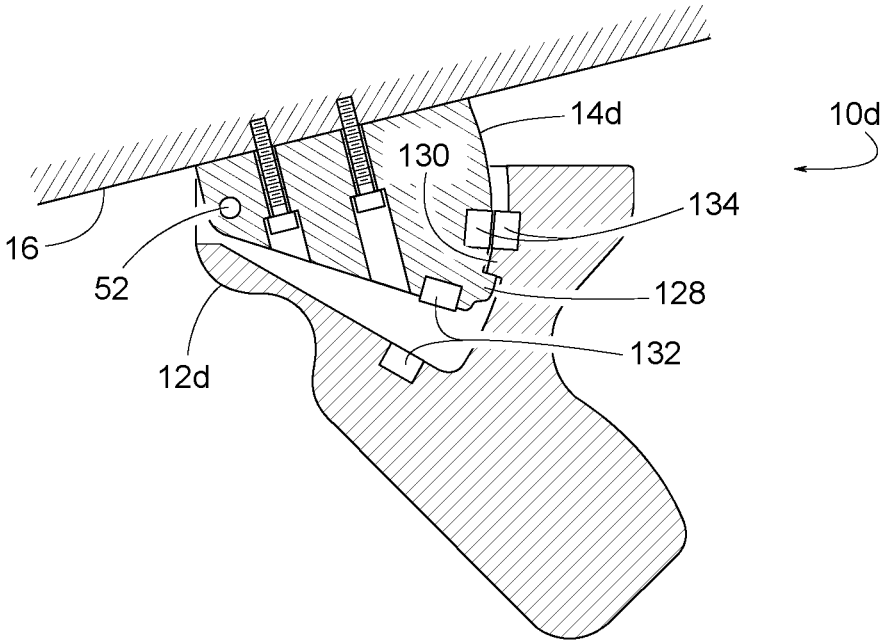
FIG. 15 is a perspective view similar to FIG. 14 but showing the light apparatus in a safety position.

FIGS. 14 and 15 show the light apparatus 10*d* comprising a protrusion 128, a backstop 130, a first magnetic pair 132, and a second magnetic pair 134. Each magnetic pair 132 and 134 comprises a main magnet paired with a second magnet or a ferrous member attracted to the main magnet.

The first magnetic pair 132 helps hold the gun mounting member 14*d* stationary relative to the frame 12 when the frame 12*d* is at the shooting position, as shown in FIG. 14. The second magnetic pair 134 helps hold the gun mounting member 14*d* stationary relative to the frame 12 when the frame 12*d* is at the safety position, as shown in FIG. 15.

Figure 16:
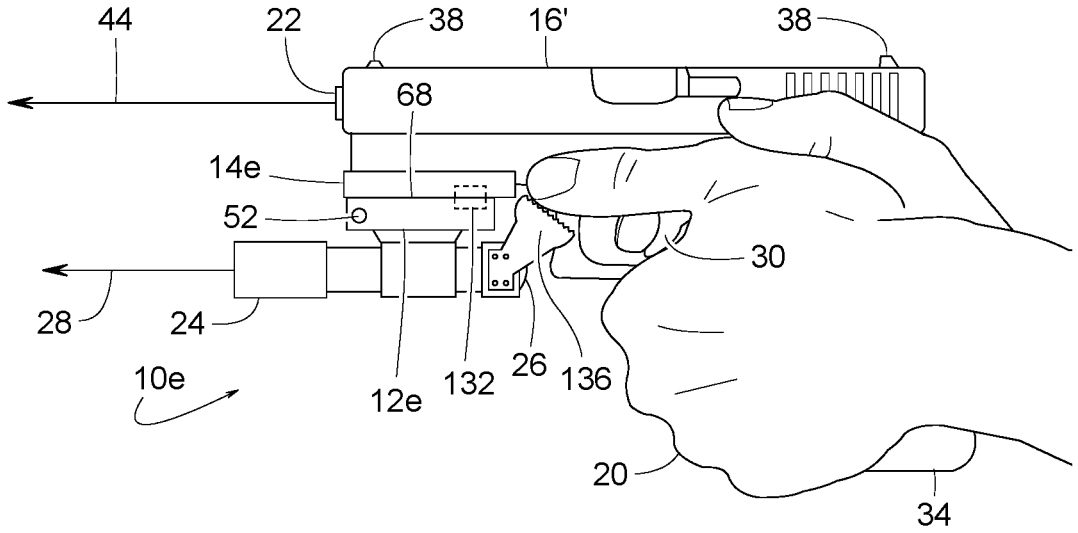
FIG. 16 is a left side view of an example light apparatus in a shooting position and constructed in accordance with the teachings disclosed herein.
Figure 17:
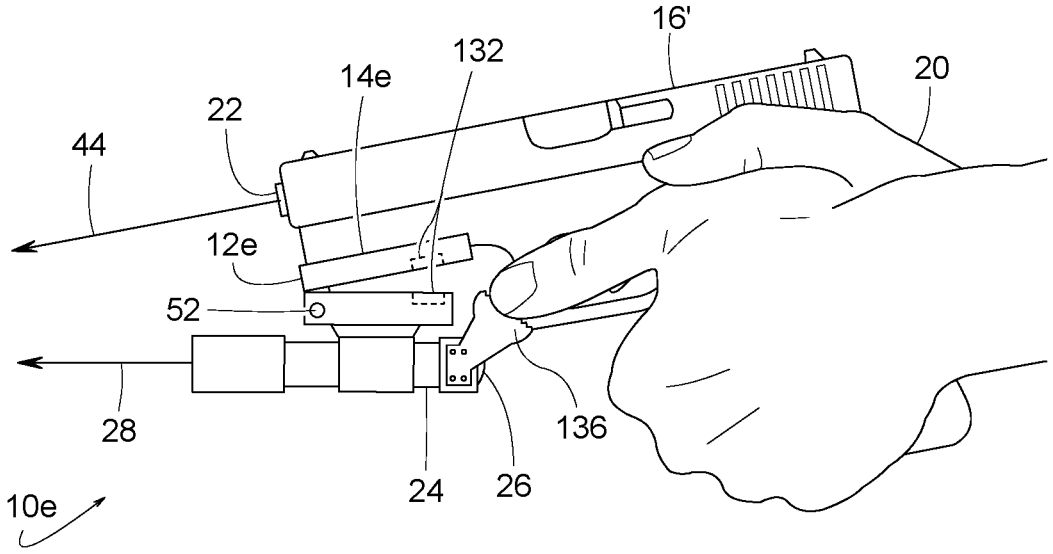
FIG. 17 is a side view similar to FIG. 16 but showing the light apparatus in a safety position.

FIGS. 16 and 17 show the light apparatus 10*e* comprising a gun mounting member 14*e* rigidly affixed to a handgun 16' (one example of the firearm 16), a frame 12*e* pivotally connected to the gun mounting member 14*e*, and the light 24 attached to the frame 12*e*. The pin 50 allows the frame 12*e* and the light 24 to pivot between the shooting position (FIG. 16) and the safety position (FIG. 17). In some examples, a thumb grip 136 on the light 24 or on the frame 12*e* helps the user 20 tilt the light 24 relative to the handgun 16'. In some examples, the magnetic pair 132 helps hold the frame 12*e* stationary relative to the gun mounting member 14*e* in the shooting position, as shown in FIG. 16.

The term, "thumb grip" refers to any structure, surface, or edge that can be readily reached, touched and moved by a user 20 while holding the handgun 16' or other firearm 16. The structure, surface or edge can be straight, curved, fluted, serrated, cross-hatched, knurled, roughened, and/or textured.

Figure 18:
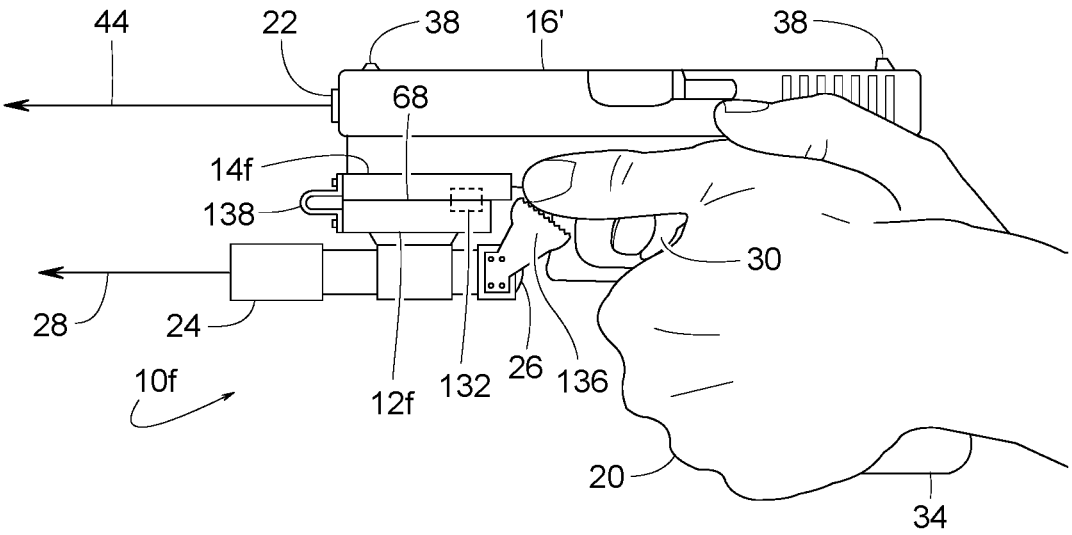
FIG. 18 is a left side view of another light apparatus in a shooting position and constructed in accordance with the teachings disclosed herein.
Figure 19:
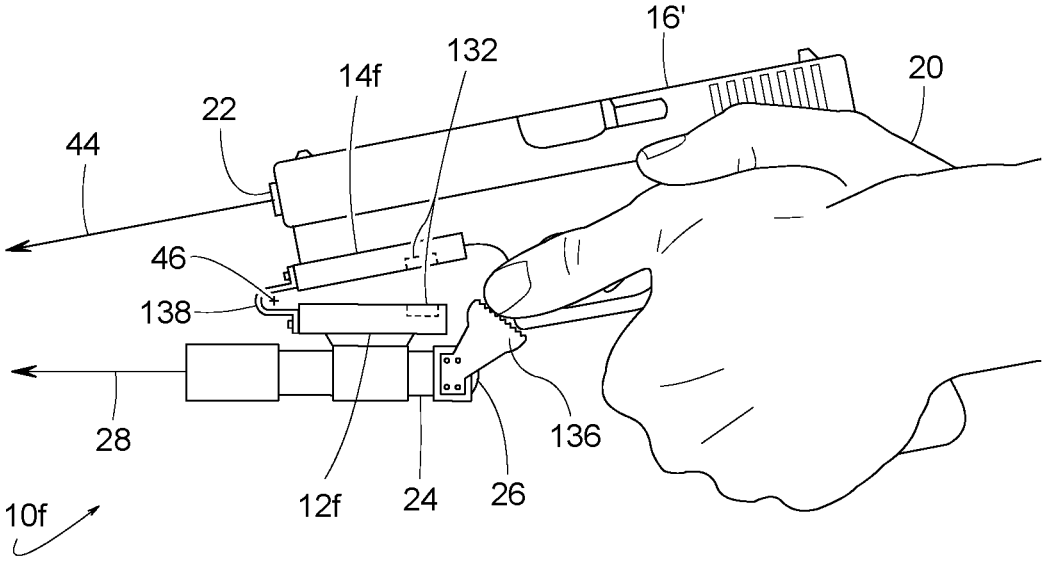
FIG. 19 is a side view similar to FIG. 18 but showing the light apparatus in a safety position.

FIGS. 18 and 19 show the light apparatus 10*f*, which is similar to light apparatus 10*e*; however, instead of the pin 50, the light apparatus 10*f* has a spring 138 (e.g., steel leaf spring, coil spring, resilient plastic member, etc.) that pivotally connects the frame 12*f* to the gun mounting member 14*f*. In this example, the axis of rotation 46 is not collinear with any pin. FIGS. 18 and 19 show the spring 138 being used with a handgun version of the firearm 16; however, the spring 138 can be used with long gun versions of the firearm 16 as well.

FIGS. 20-23 show the light apparatus 10*g* as a reconfigurable modular assembly. In some examples, the light apparatus 10*g* comprises a gun mounting member 14*g* solidly connected to the firearm 16 and pivotally connected to the frame 12*g*. A light support member 66' supports the light 24. An arm 80' couples the frame 12*g* to the light support member 66' such that the arm 80' is mountable to the frame 12*g* selectively to a right side 60' (FIGS. 21 and 23) and a left side 58' (FIGS. 20 and 22) relative to the firearm 16. The various components of the modular assembly (e.g., the frame 12*g*, the arm 80' and the light support member 66') can be disconnected and reconnected using known fasteners, such as screws.

Figure 20:
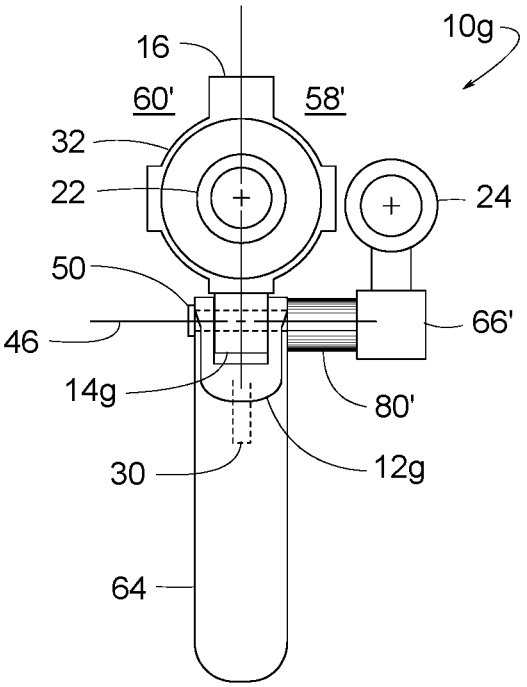
FIG. 20 is an end view of modular light apparatus constructed in accordance with the teaching disclosed herein, wherein the end view looks along the X-axis in the back direction into the barrel, and the light is off to the left side of the firearm and in a first position above a light support member.
Figure 21:
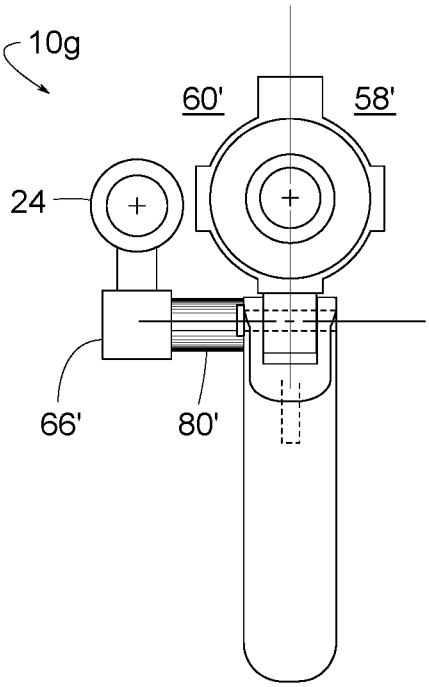
FIG. 21 is an end view similar to FIG. 20 but showing the modular light apparatus configured such that the light is off the right side of the firearm.
Figure 22:
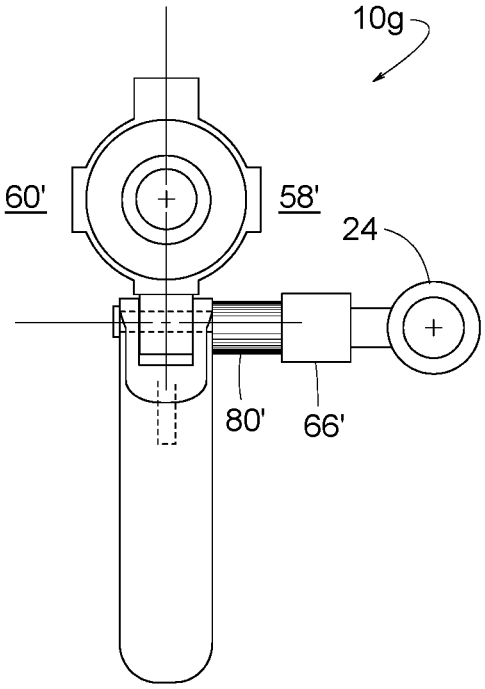
FIG. 22 is an end view similar to FIG. 20 but showing the light in a second position, wherein the light is off to one side of the light support member.
Figure 23:
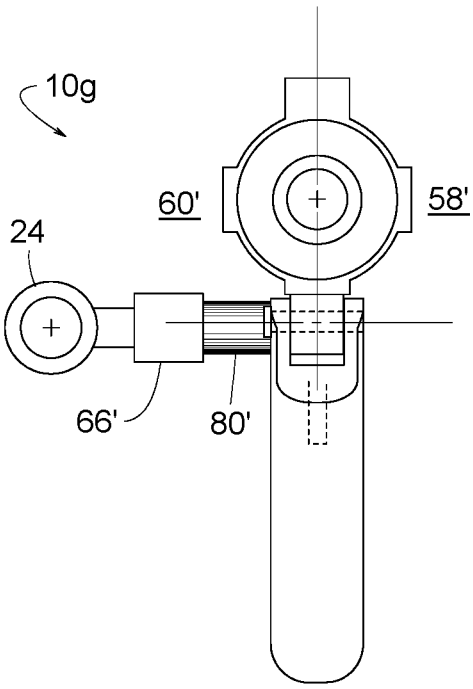
FIG. 23 is an end view similar to FIG. 21 but showing the light in the second position, wherein the light is off to one side of the light support member.

In some examples of the light apparatus 14*g*, the light 24 is mountable to the light support member 66' selectively to a first position and a second position. The light 24 in the first position is above the light support member 66', as shown in FIGS. 20 and 21. The light 24 in the second position is laterally off to one side of the light support member 66', as shown in FIGS. 22 and 23.

Some of the examples shown in FIGS. 1-23 show the mounting surface 68 of the gun mounting member 14 directly against the handguard 32. In some examples, the gun mounting member 14 is attached to the firearm 16 by way of a rail integration system 40, wherein the mounting surface 68 engages the rail integration system 40. In some examples, the rail integration system 40 is mounted to the underside of the firearm 16 and couples the gun mounting member 14 to the handguard 32, the barrel 22, and/or another part of the firearm 116. In some examples, the gun mounting member 14 is a seamless integral extension of the firearm 16 itself.

In some examples, the frame 12 moving between its safety position and shooting position serves as an electrical switch actuator for controlling the light 24, such that the light beam 28 changes in intensity or color depending on whether the frame 12 is in the safety position or shooting position.

In some examples of the light apparatus 10, the spring loaded detent 112, the movable backstop 120, the spring 100, and/or a separate device can be locked to more firmly hold the frame 12 in the shooting position when desired. In some examples, the spring loaded detent 112, the movable backstop 120, the magnetic pairs 132 and 134, and/or other device provides a tactile or visual indication that the frame 12 is in the shooting position.

In some examples, the central light pointing direction 84 can be adjusted or redirected between the safety position and the shooting position using movable items such as mirrors, lens, and/or movable LEDs (light emitting diodes) within the light 24. In some examples, such movable items can be considered to be supported by the frame 12, whereby moving such items equates to moving the frame 12. In some examples, the light 24, mirrors, lens, and/or LEDs are an integral part of the frame 12 itself.

Some examples of the light apparatus 10*a-g* can be defined as described in the following examples 1-34.

Example-1 A light apparatus comprising: a firearm that includes a barrel; a frame pivotally coupled to the firearm, the frame being pivotal about an axis of rotation selectively to a shooting position and a safety position relative to the firearm; a light supported at a stationary position relative to the frame, the light projecting a light beam in a central light pointing direction; when the frame is in the shooting position, the barrel is substantially parallel to the central light pointing direction; and when the gun mounting member is in the safety position while the central light pointing direction is horizontal, the barrel slopes down.

Example-2 The light apparatus of Example-1, wherein the firearm includes a trigger extending downward, the axis of rotation extends in a lateral direction, and the light is laterally offset to the firearm in the lateral direction, such that when the barrel is horizontal with the trigger extending downward, the frame extends underneath the barrel while the light is laterally off to one side of the barrel.

Example-3 The light apparatus of Example-1, wherein the axis of rotation is closer to a front end of the frame than to a back end of the frame.

Example-4 The light apparatus of Example-1, wherein the frame includes a foregrip with distal end leaning back.

Example-5 The light apparatus of Example-1, further comprising: a backstop on the frame; a gun mounting member solidly connected to the firearm and pivotally connected to the frame; a protrusion extending from the gun mounting member, the protrusion being closer to a back end of the gun mounting member than to a front end of the gun mounting member; and a cavity defined by the frame, the protrusion and the gun mounting member extending into the cavity, the protrusion engaging the backstop within the cavity when the frame is in the safety position, the protrusion being spaced apart from the backstop when the frame is in the shooting position.

Example-6 The light apparatus of Example-5, wherein the backstop is movable selectively to a restraining position and a release position relative to the frame, the backstop being more restrictive of the gun mounting member moving when the backstop is in the restraining position than in the release position.

Example-7 The light apparatus of Example-1, further comprising: a gun mounting member solidly connected to the firearm and pivotally connected to the frame; and a spring loaded detent holding the gun mounting member stationary relative to the frame when the frame is in the shooting position.

Example-8 The light apparatus of Example-1, wherein the firearm is a long gun.

Example-9 The light apparatus of Example-1, wherein the firearm is a handgun.

Example-10 The light apparatus of Example-1, wherein the firearm includes a handguard encircling the barrel, and the frame is attached to the handguard.

Example-11 The light apparatus of Example-1, wherein the firearm includes a rail integration system attached to the barrel, and the frame is attached to the rail integration system.

Example-12 The light apparatus of Example-1, further comprising: a gun mounting member solidly connected to the firearm and pivotally connected to the frame; and a magnet holding the gun mounting member stationary relative to the frame when the frame is in the shooting position.

Example-13 The light apparatus of Example-1, further comprising a thumb grip on at least one of the light and the frame to facilitate tilting the light relative to the firearm.

Example-14 A light apparatus mountable to a firearm that includes a trigger extending downward and a barrel, the light apparatus comprising: a frame; a light support member being stationary relative to the frame, the light support member establishing a central light pointing direction relative to the frame; a gun mounting member pivotally connected to the frame, the frame being pivotal about an axis of rotation selectively to a shooting position and a safety position relative to the gun mounting member; a mounting surface on the gun mounting member to engage the firearm to establish a fixed positional relationship between the barrel and the gun mounting member, the mounting surface comprising a back end and a front end; when the frame is in the shooting position, the mounting surface is substantially parallel to the central light pointing direction; and when the frame is in the safety position while the central light pointing direction is horizontal, the mounting surface slopes downward from the back end to the front end.

Example-15 The light apparatus of Example-14, wherein the axis of rotation extends in a lateral direction, and the light support member is laterally offset to the gun mounting member in the lateral direction, such that when the gun mounting member is attached to the firearm while the barrel is horizontal and the trigger extending downward, the gun mounting member is underneath the barrel, and the light support member is laterally off to one side of the barrel.

Example-16 The light apparatus of Example-14, wherein the barrel slopes down when the gun mounting member is attached to the firearm while the central light pointing direction is horizontal and the frame is in the safety position.

Example-17 The light apparatus of Example-14, wherein the light support member includes a ledge to support a light such that the ledge is substantially parallel to the central light pointing direction.

Example-18 The light apparatus of Example-14, wherein the light support member includes a tubular member to support a light, the tubular member having a longitudinal centerline that is substantially parallel to the central light pointing direction.

Example-19 The light apparatus of Example-14, wherein the axis of rotation is closer to the front end than to the back end.

Example-20 The light apparatus of Example-14, wherein the frame includes a backstop, the gun mounting member includes a protrusion that is closer to the back end than to the front end, the frame defines a cavity, the protrusion and the gun mounting member extend into the cavity, the protrusion engages the backstop within the cavity when the frame is in the safety position, the protrusion is spaced apart from the backstop when the frame is in the shooting position.

Example-21 The light apparatus of Example-20, wherein the backstop is movable selectively to a restraining position and a release position relative to the frame, the backstop being more restrictive of the gun mounting member moving when the backstop is in the restraining position than in the release position.

Example-22 The light apparatus of Example-14, further comprising a spring loaded detent holding the gun mounting member stationary relative to the frame when the frame is in the shooting position.

Example-23 The light apparatus of Example-14, wherein the frame includes a foregrip with distal end leaning back.

Example-24 The light apparatus of Example-14, further comprising a magnet holding the gun mounting member stationary relative to the frame when the frame is in the shooting position.

Example-25 The light apparatus of Example-14, further comprising a thumb grip on at least one of the light support member and the frame to facilitate tilting the light support member relative to the gun mounting member.

Example-26 The light apparatus of Example-14, wherein the firearm is a long gun.

Example-27 The light apparatus of Example-14, wherein the firearm is a handgun.

Example-28 The light apparatus of Example-14, wherein the firearm includes a handguard encircling the barrel, and the mounting surface engages the handguard when the light apparatus is attached to the firearm.

Example-29 The light apparatus of Example-14, wherein the firearm includes a rail integration system attached to the barrel, and the mounting surface engages the rail integration system when the light apparatus is attached to the firearm.

Example-30 A light apparatus comprising: a firearm that includes a trigger extending downward and a barrel; a frame; a light support member being stationary relative to the frame; a light attached to the light support member, the light projecting a light beam in a central light pointing direction relative to the frame; a gun mounting member pivotally connected to the frame, the frame being pivotal about an axis of rotation selectively to a shooting position and a safety position relative to the gun mounting member; a mounting surface on the gun mounting member to engage the firearm, the gun mounting surface being substantially parallel to the barrel, the mounting surface comprising a back end and a front end, the axis of rotation being closer to the front end than to the back end, the axis of rotation extending in a lateral direction, and the light being laterally offset to the barrel in the lateral direction, such that when the barrel is horizontal and the trigger is extending downward, the gun mounting member is underneath the barrel, and the light is laterally off to one side of the barrel; when the frame is in the shooting position, the barrel is substantially parallel to the central light pointing direction; and when the frame is in the safety position while the central light pointing direction is horizontal, the mounting surface slopes downward from the back end to the front end, consequently the barrel slopes downward as well.

Example-31 The light apparatus of Example-1, further comprising gun mounting member solidly connected to the firearm and pivotally connected to the frame; a light support member supporting the light; and an arm coupling the frame to the light support member, the arm being mountable to the frame selectively to a right side and a left side relative to the firearm.

Example-32 The light apparatus of Example-31, wherein the light is mountable to the light support member selectively to a first position and a second position, wherein the light in the first position is above the light support member, and the light in the second position is laterally off to one side of the light support member.

Example-33 The light apparatus of Example-14, further comprising an arm coupling the frame to the light support member, the arm being mountable to the frame selectively to a right side and a left side relative to the firearm.

Example-34 The light apparatus of Example-33, wherein the light is mountable to the light support member selectively to a first position and a second position, wherein the light in the first position is above the light support member, and the light in the second position is laterally off to one side of the light support member.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The invention claimed is:

1. A light apparatus comprising:

a firearm that includes a barrel;

a frame pivotally coupled to the firearm, the frame being pivotal about an axis of rotation selectively to a shooting position and a safety position relative to the firearm;

a light supported at a stationary position relative to the frame, the light projecting a light beam in a central light pointing direction;

when the frame is in the shooting position, the barrel is substantially parallel to the central light pointing direction; and when the gun mounting member is in the safety position while the central light pointing direction is horizontal, the barrel slopes down.

2. The light apparatus of claim 1, wherein the firearm includes a trigger extending downward, the axis of rotation extends in a lateral direction, and the light is laterally offset to the firearm in the lateral direction, such that when the barrel is horizontal with the trigger extending downward, the frame extends underneath the barrel while the light is laterally off to one side of the barrel.

3. The light apparatus of claim 1, wherein the axis of rotation is closer to a front end of the frame than to a back end of the frame.

4. The light apparatus of claim 1, wherein the frame includes a foregrip with distal end leaning back.

5. The light apparatus of claim 1, further comprising:

a backstop on the frame;

a gun mounting member solidly connected to the firearm and pivotally connected to the frame;

a protrusion extending from the gun mounting member, the protrusion being closer to a back end of the gun mounting member than to a front end of the gun mounting member; and a cavity defined by the frame, the protrusion and the gun mounting member extending into the cavity, the protrusion engaging the backstop within the cavity when the frame is in the safety position, the protrusion being spaced apart from the backstop when the frame is in the shooting position.

6. The light apparatus of claim 5, wherein the backstop is movable selectively to a restraining position and a release position relative to the frame, the backstop being more restrictive of the gun mounting member moving when the backstop is in the restraining position than in the release position.

7. The light apparatus of claim 1, further comprising:

a gun mounting member solidly connected to the firearm and pivotally connected to the frame; and a spring loaded detent holding the gun mounting member stationary relative to the frame when the frame is in the shooting position.

8. The light apparatus of claim 1, wherein the firearm includes a handguard encircling the barrel, and the frame is attached to the handguard.

9. The light apparatus of claim 1, further comprising:

a gun mounting member solidly connected to the firearm and pivotally connected to the frame;

a light support member supporting the light; and an arm coupling the frame to the light support member, the arm being mountable to the frame selectively to a right side and a left side relative to the firearm.

10. A light apparatus mountable to a firearm that includes a trigger extending downward and a barrel, the light apparatus comprising:

a frame;

a light support member being stationary relative to the frame, the light support member establishing a central light pointing direction relative to the frame;

a gun mounting member pivotally connected to the frame, the frame being pivotal about an axis of rotation selectively to a shooting position and a safety position relative to the gun mounting member;

a mounting surface on the gun mounting member to engage the firearm to establish a fixed positional relationship between the barrel and the gun mounting member, the mounting surface comprising a back end and a front end;

when the frame is in the shooting position, the mounting surface is substantially parallel to the central light pointing direction; and when the frame is in the safety position while the central light pointing direction is horizontal, the mounting surface slopes downward from the back end to the front end.

11. The light apparatus of claim 10, wherein the axis of rotation extends in a lateral direction, and the light support member is laterally offset to the gun mounting member in the lateral direction, such that when the gun mounting member is attached to the firearm while the barrel is horizontal and the trigger extending downward, the gun mounting member is underneath the barrel, and the light support member is laterally off to one side of the barrel.

12. The light apparatus of claim 10, wherein the barrel slopes down when the gun mounting member is attached to the firearm while the central light pointing direction is horizontal and the frame is in the safety position.

13. The light apparatus of claim 10, wherein the light support member includes a ledge to support a light such that the ledge is substantially parallel to the central light pointing direction.

14. The light apparatus of claim 10, wherein the light support member includes a tubular member to support a light, the tubular member having a longitudinal centerline that is substantially parallel to the central light pointing direction.

15. The light apparatus of claim 10, wherein the axis of rotation is closer to the front end than to the back end.

16. The light apparatus of claim 10, wherein the frame includes a backstop, the gun mounting member includes a protrusion that is closer to the back end than to the front end, the frame defines a cavity, the protrusion and the gun mounting member extend into the cavity, the protrusion engages the backstop within the cavity when the frame is in the safety position, the protrusion is spaced apart from the backstop when the frame is in the shooting position.

17. The light apparatus of claim 16, wherein the backstop is movable selectively to a restraining position and a release position relative to the frame, the backstop being more restrictive of the gun mounting member moving when the backstop is in the restraining position than in the release position.

18. The light apparatus of claim 10, further comprising a spring loaded detent holding the gun mounting member stationary relative to the frame when the frame is in the shooting position.

19. The light apparatus of claim 10, further comprising an arm coupling the frame to the light support member, the arm being mountable to the frame selectively to a right side and a left side relative to the firearm.

20. A light apparatus comprising:

a firearm that includes a trigger extending downward and a barrel;

a frame;

a light support member being stationary relative to the frame;

a light attached to the light support member, the light projecting a light beam in a central light pointing direction relative to the frame;

a gun mounting member pivotally connected to the frame, the frame being pivotal about an axis of rotation selectively to a shooting position and a safety position relative to the gun mounting member;

a mounting surface on the gun mounting member to engage the firearm, the gun mounting surface being substantially parallel to the barrel, the mounting surface comprising a back end and a front end, the axis of rotation being closer to the front end than to the back end, the axis of rotation extending in a lateral direction, and the light being laterally offset to the barrel in the lateral direction, such that when the barrel is horizontal and the trigger is extending downward, the gun mounting member is underneath the barrel, and the light is laterally off to one side of the barrel;

when the frame is in the shooting position, the barrel is substantially parallel to the central light pointing direction; and when the frame is in the safety position while the central light pointing direction is horizontal, the mounting surface slopes downward from the back end to the front end, consequently the barrel slopes downward as well.

* * * * *